US012728955B1

(12) United States Patent
Sanborn

(10) Patent No.: US 12,728,955 B1
(45) Date of Patent: Sep. 8, 2026

(54) MARINE VESSEL POWER SYSTEMS AND CONTROL METHODS

(71) Applicant: Navico Group Americas LLC, Menomonee Falls, WI (US)

(72) Inventor: James J. Sanborn, Lowell, MI (US)

(73) Assignee: Navico Group Americas LLC, Menomonee Falls, WI (US)

( * ) Notice: Subject to any disclaimer, the term of this patent is extended or adjusted under 35 U.S.C. 154(b) by 112 days.

(21) Appl. No.: 18/644,703

(22) Filed: Apr. 24, 2024

(51) Int. Cl.

| | |
|---|---|
| ***B63B 13/00*** | (2006.01) |
| ***B63B 79/10*** | (2020.01) |
| ***B63B 79/30*** | (2020.01) |
| ***B63B 79/40*** | (2020.01) |
| ***B63H 21/17*** | (2006.01) |

(52) U.S. Cl.
CPC ..... *B63B 13/00* (2013.01); *B63B 79/10* (2020.01); *B63B 79/30* (2020.01); *B63B 79/40* (2020.01); *B63H 21/17* (2013.01)

(58) Field of Classification Search
CPC ..... B63B 79/10; B63B 79/30; B63B 79/40
See application file for complete search history.

(56) References Cited

U.S. PATENT DOCUMENTS

| | | | | |
|---|---|---|---|---|
| 6,507,164 | B1 | 1/2003 | Healey et al. | |
| 6,902,446 | B1 | 6/2005 | Healey | |
| 7,104,856 | B1 | 9/2006 | Krupp et al. | |
| 7,189,125 | B2 * | 3/2007 | Okuyama | B63H 21/17 440/1 |
| 10,017,136 | B1 | 7/2018 | Waisanen et al. | |
| 10,202,180 | B1 | 2/2019 | Amerling et al. | |
| 10,511,121 | B2 | 12/2019 | Milroy et al. | |
| 10,710,691 | B2 | 7/2020 | Amerling et al. | |
| 11,046,405 | B1 | 6/2021 | Groeschel et al. | |
| 11,377,186 | B1 | 7/2022 | Ahlswede et al. | |
| 2022/0194542 | A1 | 6/2022 | Kirchhoff et al. | |
| 2022/0200070 | A1 | 6/2022 | Gonring | |
| 2022/0328893 | A1 | 10/2022 | Oenick et al. | |
| 2022/0328912 | A1 | 10/2022 | Gonring | |

(Continued)

FOREIGN PATENT DOCUMENTS

| | | | | |
|---|---|---|---|---|
| CA | 2887204 C | * | 9/2023 | G01F 23/0015 |
| JP | 2008041507 | | 2/2008 | |

(Continued)

*Primary Examiner* — James J Lee
*Assistant Examiner* — Brandon S Lee
(74) *Attorney, Agent, or Firm* — Andrus Intellectual Property Law, LLP

(57) ABSTRACT

A power system for a marine vessel includes a plurality of battery cell packs powering a vessel load, including at least a first cell pack and a second cell pack, each battery cell pack comprising a plurality of battery cells encapsulated in an external housing configured to be separately mounted in the hull of the marine vessel. At least one low water sensor is positioned at a lowest point of the marine vessel occupied by at least one of the plurality of battery cell packs. At least one high water sensor is positioned higher on the marine vessel than the low water sensor. At least one hardware controller is configured to detect a submersion event based on an output of the high water sensor and an output of the low water sensor, and generate an ingress mitigation action in response to detection of the submersion event.

20 Claims, 7 Drawing Sheets

(56) References Cited

U.S. PATENT DOCUMENTS

| | | | | |
|---|---|---|---|---|
| 2022/0328943 | A1* | 10/2022 | Mueller | H01M 50/574 |
| 2024/0405298 | A1* | 12/2024 | Wiebenga | H01M 50/3425 |

FOREIGN PATENT DOCUMENTS

| | | |
|---|---|---|
| JP | 6540792 | 7/2019 |
| KR | 20120117477 | 10/2012 |
| KR | 20230061042 | 5/2023 |

* cited by examiner

MARINE VESSEL POWER SYSTEMS AND CONTROL METHODS

FIELD

The present disclosure generally relates to systems and methods for controlling a plurality of high voltage batteries on a marine vessel, and more particularly systems and methods for detecting and mitigating water ingress events.

BACKGROUND

The following U.S. Patents and applications provide background information and are incorporated herein by reference, each in its entirety:

U.S. patent application Ser. No. 17/716,745, filed on Apr. 8, 2022 and published as U.S. Patent Application publication No. 2022/0328893 on Oct. 13, 2022, relates to a marine battery pack including an enclosure defining a cavity, a plurality of cell modules within the cavity, each comprising a plurality of battery cells, and at least one sensor configured to sense at least one of a temperature, a pressure, a presence of water, and a gas content within the cavity. A controller is configured to detect an event warranting decommission of the battery pack based on the temperature, the pressure, the presence of water, and/or the gas content within the cavity, and then to automatically operate a pump to intake water from outside of the enclosure and pump water through the cavity from an inlet port in the enclosure to an outlet port in the enclosure so as to cool the plurality of battery cells.

U.S. patent application Ser. No. 17/716,732, filed on Apr. 8, 2022 and published as U.S. Patent Application publication No. 2022/0328943 on Oct. 13, 2022, relates to a marine battery pack including a battery enclosure having an exterior and an interior defining a cavity, wherein the battery enclosure is configured to protect against water ingress into the cavity. The marine battery pack further comprises a plurality of cell modules within the cavity, each including a plurality of battery cells, and at least one exterior sensor on the battery enclosure configured to sense at least one of an exterior temperature, an exterior pressure, and a presence of water on the exterior of the battery enclosure. A controller is configured to identify a water exposure event based on the at least one of the exterior temperature, the exterior pressure, and the presence of water on the exterior of the battery enclosure. A water exposure response is then generated.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one aspect of the present disclosure, a power system is for a marine vessel. The system comprises a plurality of battery cell packs, including at least a first cell pack and a second cell pack, each battery cell pack comprising a plurality of battery cells encapsulated in an external housing configured to be separately mounted in the hull of the marine vessel. A vessel load is powered by the plurality of battery cell packs. At least one low water sensor is positioned at a lowest point of the marine vessel occupied by at least one of the plurality of battery cell packs, and at least one high water sensor is positioned higher on the marine vessel than the low water sensor. At least one hardware controller is configured to detect a submersion event based on an output of the high water sensor and an output of the low water sensor, and to generate an ingress mitigation action in response to detection of the submersion event.

In one embodiment, the low water sensor is configured to power on the at least one hardware controller when water is sensed, wherein upon powering on, the at least one hardware controller is configured to execute instructions to detect the submersion event.

In another embodiment, the low water sensor is a float switch.

In another embodiment, the ingress mitigation action includes generating a water ingress alert on a user interface device.

In another embodiment, the power system comprises a first disconnect switch positioned outside of the external housing of the first cell pack and configured to disconnect the first cell pack from the vessel load and a second disconnect switch positioned outside of the external housing of the second cell pack and configured to disconnect the second cell pack from the vessel load. The ingress mitigation action includes controlling the first disconnect switch and the second disconnect switch.

In another embodiment, the ingress mitigation action includes controlling the first disconnect switch to disconnect the first cell pack from the vessel load and controlling the second disconnect switch to disconnect the second cell pack from the vessel load.

In another embodiment, the ingress mitigation action includes controlling the vessel load to stop power draw from the battery cell packs prior to controlling the first disconnect switch to disconnect the first cell pack and controlling the second disconnect switch to disconnect the second cell pack.

In another embodiment, the vessel load comprises at least one marine drive, and the ingress mitigation action includes executing an automatic shut down of the marine drive to stop power draw by the marine drive from the battery cell packs.

In another embodiment the ingress mitigation action includes controlling at least one fuse to disconnect the vessel load from the plurality of battery cell packs.

In another embodiment, the power system comprises a first battery cooling system configured to cool the first cell pack and a second battery cooling system configured to cool the second cell pack. The ingress mitigation action includes increasing the cooling activity of at least one of the first battery cooling system or the second battery cooling system.

In another embodiment, detection of the submersion event includes water being sensed by at least one of the low water sensor and the high water sensor for a predetermined exposure time.

In another embodiment, detection of the submersion event includes sensing water with both the low water sensor and the high water sensor.

In another embodiment, the at least one high water sensor comprises a plurality of high water sensors, including at least a first high water sensor on the external housing of the first cell pack and a second high water sensor on the external housing of the second cell pack. Detection of the submersion event includes sensing water with at least two of the low water sensor, the first high water sensor, and the second high water sensor.

In another embodiment, the first high water sensor is at or near a high point of the external housing of the first cell pack and the second high water sensor is at or near a high point of the external housing of the second cell pack.

In another embodiment, the at least one high water sensor comprises a plurality of high water sensors on at least one of the external housing of the first cell pack or the external housing of the second cell pack, wherein detection of the submersion event includes sensing water with at least two water sensors out of the low water sensor and the plurality of high water sensors.

In another embodiment, the power system further comprises at least a first gas sensor positioned adjacent to a vent of the external housing of the first cell pack and a second gas sensor positioned adjacent to a vent of the external housing of the second cell pack. The first gas sensor and the second gas sensor are each configured to sense at least one gas associated with a thermal event in the plurality of battery cells. Detection of the submersion event includes detecting with at least one of the first gas sensor or the second gas sensor the at least one gas associated with the thermal event.

In another embodiment, the power system comprises an orientation sensor associated with at least one of the plurality of battery cell packs. The at least one hardware controller is configured to detect an inversion of the at least one of the plurality of battery cell packs and, in response to detecting the inversion, change a logic for detecting the submersion event based on the output of the high water sensor and the output of the low water sensor.

In another embodiment, in response to detecting the inversion, the controller is configured to operate the at least one high water sensor to sense water at a low portion of the plurality of battery cell packs.

In another embodiment, the low water sensor is a float switch and wherein, in response to detecting the inversion, the at least one hardware controller is configured to interpret an off position of the float switch as sensing the presence of water.

In another aspect of the present disclosure, a method id for controlling a power system for a marine vessel, the power system comprising a plurality of battery cell packs, including at least a first cell pack and a second cell pack, each marine battery cell pack comprising a plurality of battery cells encapsulated in an external housing configured to be separately mounted in the hull of the marine vessel, and a vessel load powered by the plurality of battery cell packs. The method comprises sensing a presence of water with a low water sensor at a lowest point of the marine vessel occupied by at least one of the plurality of battery cell packs and/or with at least one high water sensor positioned higher on the marine vessel than the low water sensor, detecting a submersion event based on the presence of water sensed by the high water sensor and/or the low water sensor, and generating an ingress mitigation action in response to detection of the submersion event.

In another embodiment, the method further comprises starting a timer upon detecting water with the low water sensor and detecting the submersion event upon the timer reaching a predetermined exposure time or upon sensing the presence of water with the high water sensor.

In another embodiment, the method the method further comprises detecting an inversion of at least one of the plurality of battery cell packs and, in response to detecting the inversion, change a logic for detecting the submersion event based on the output of the high water sensor and the output of the low water sensor.

BRIEF DESCRIPTION OF THE DRAWINGS

The present disclosure includes the following Figures.

DETAILED DESCRIPTION

Figure 1:
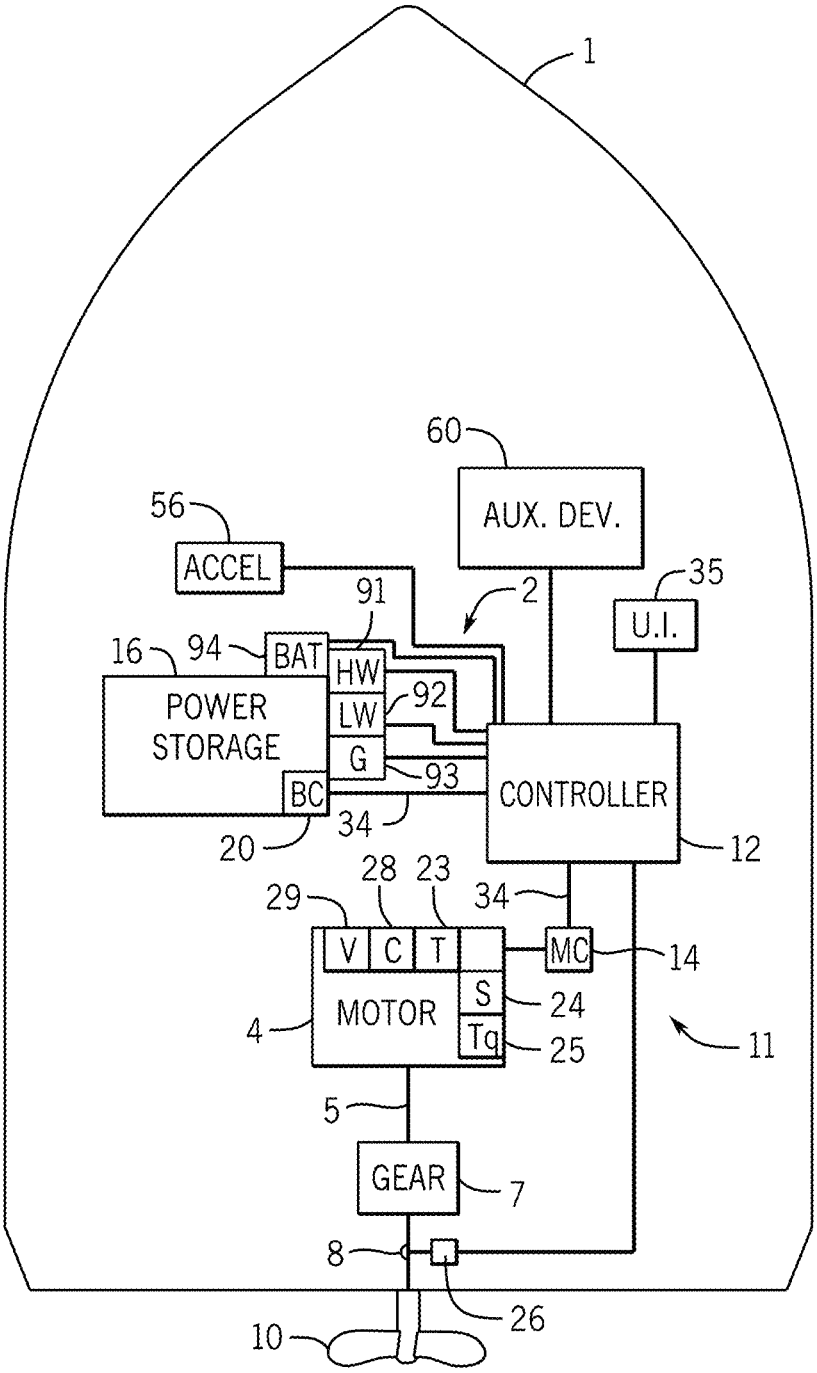
FIG. 1 is a schematic depiction of a marine vessel having an exemplary electric marine propulsion system according to one embodiment of the present disclosure.

The present disclosure relates to methods and systems for managing connection of high voltage batteries to an electrical load for a high voltage system on a marine vessel. Vehicle electrification and the application of electric marine propulsion systems and high voltage battery technology for electrical energy storage poses a different set of hazards than traditional internal combustion engines and liquid fuel storage. For example, additional hazards are created in the marine environment when li-ion batteries having liquid organic electrolytes come in contact with water. The inventors have recognized that particular issues may arise relating to battery conditions on marine vessels and other marine-related electrical energy storage with high voltage cells. Boaters on open water may not be able to reach a safe location in event of a battery fire or other hazardous battery event. Moreover, having the vessel surrounded by water, which is a conductor, creates a hazard that needs to be accounted for when a catastrophic battery event occurs. These hazards may be amplified on marine vessels which include a non-marine battery without specialized hazard mitigation features. Non-marine batteries, for example, may not include sensors for detecting humidity within the battery housing and therefore are unable to determine if the non-marine battery has been submerged. Thus, the inventor has recognized a need for a marine battery system and monitoring methods that provide detection and mitigation of potential hazards of a battery-driven electric marine propulsion system that utilizes a non-marine battery for power storage.

Given those challenges, the inventor developed the disclosed system and method for detecting submersion of the marine battery system, including events indicating risk of water ingress and generating a mitigation response in the power storage system and/or in the vessel electrical load. The disclosed system and method are configured to monitor the marine power storage system, such as a non-marine battery cell pack on a marine vessel (or otherwise in a marine environment), via multiple sensors and detect a hazardous condition that warrants further action. The system may include various external sensors external to the battery cell packs and sensing analysis methods to detect a water submersion event where at least one non-marine battery cell pack has been exposed to and/or at least partially immersed in water, and/or to detect when an event has occurred that warrants decommissioning of the battery. The inventor has recognized that high voltage marine battery systems may include multiple high voltage cell packs that are separately housed and distributed at two or more locations within the vessel hull. Given that marine vessels are sensitive to weight imbalances, including both fore-aft and lateral imbalances, and that the cell packs typically weigh several hundred pounds each, installation of a high voltage marine battery system may comprise distributing the cell packs fore and aft and laterally with respect to the vessel centerline to properly balance the boat and accommodate passenger areas, etc. Thus, external monitoring of the cell packs involves placing sensors strategically based on the location of each cell pack in the vessel hull.

The disclosed system includes multiple water sensors at different locations proximate the battery cell pack(s) to determine a water level relative to the battery cell packs, as well as temperature and gas sensors configured to sense conditions indicative of a submersion event. Orientation sensor are configured to determine if any battery cell packs have been inverted, and the system is configured to take steps to account for the inverted orientation when sensing for a submersion event. Upon detection of a submersion event, for example, the system is configured to automatically trigger a sequence of safety systems to address and mitigate various hazardous circumstances, such as electric shock. For example, the system may be configured to disconnect the high voltage battery cell packs from the electrical load(s) of the marine vessel.

FIG. 1 depicts an exemplary embodiment of a marine vessel 1 having an electric marine propulsion system 2 configured to propel the marine vessel in a direction instructed by an operator via a steering control system, or by a guidance system configured to automatically control steering of the marine vessel to steer the vessel toward a predetermined location or global position. The electric propulsion system 2 may include at least one electric marine drive 3 having an electric motor 4 configured to propel the marine vessel 1 by rotating a propeller 10, may be connected to a power storage system 16, and may include a user interface system 35. The electric marine propulsion system 2 may include an outboard marine drive 3 having an electric motor 4 housed therein, such as housed within the cowl of the outboard marine drive. A person of ordinary skill in the art will understand in view of the present disclosure that the marine propulsion system 2 may include other types of electric marine drives 3, such as inboard drives or stem drives. The electric marine drive 3 is powered by the scalable storage device 16, such as including a bank of batteries.

The electric marine propulsion system 2 may include one or a plurality of electric marine drives 3, each comprising at least one electric motor 4 configured to rotate a propulsor, or propeller 10. The motor 4 may be, for example, a brushless electric motor, such as a brushless DC motor. In other embodiments, the electric motor may be a DC brushed motor, an AC brushless motor, a direct drive, a permanent magnet synchronous motor, an induction motor, or any other device that converts electric power to rotational motion. In certain embodiments, the electric motor 4 includes a rotor and a stator in a known configuration.

The electric motor 4 is electrically connected to and powered by a power storage system 16. The power storage system 16 stores energy for powering the electric motor 4 and is rechargeable, such as by connection to shore power when the electric motor 4 is not in use. Various power storage devices and systems are known in the relevant art. The power storage system 16 may be a battery system including one or more batteries or banks of batteries. At least one battery may be configured as a high voltage battery cell pack comprising a plurality of battery cells enclosed within an external housing. For example, the power storage system 16 may include one or more lithium-ion (LI) battery systems, each LI battery comprised of multiple battery cells. In other embodiments, the power storage system 16 may include one or more lead-acid batteries, fuel cells, flow batteries, ultracapacitors, and/or other devices capable of storing and outputting electric energy.

The electric motor 4 is operably connected to the propeller 10 and configured to rotate the propeller 10. As will be known to the ordinary skilled person in the relevant art, the propeller 10 may include one or more propellers, impellers, or other propulsor devices and that the term "propeller" may be used to refer to all such devices. In certain embodiments, such as that represented in FIG. 1, the electric motor 4 may be connected and configured to rotate the propeller 10 through a gear system 7 or a transmission. In such an embodiment, the gear system 7 translates rotation of the motor output shaft 5 to the propeller shaft 8 to adjust conversion of the rotation and/or to disconnect the propeller shaft 8 from the drive shaft 5, as is sometimes referred to in the art as a "neutral" position where rotation of the drive shaft 5 is not translated to the propeller shaft 8. Various gear systems 7, or transmissions, are well known in the relevant art. In other embodiments, the electric motor 4 may directly collect to the propeller shaft 8 such that rotation of the drive shaft 5 is directly transmitted to the propeller shaft 8 at a constant and fixed ratio.

The power storage system 16 may further include a battery controller 20 configured to monitor and/or control aspects of the power storage system 16. The battery controller 20 (e.g., a battery management system ('BMS')) may further be configured to receive information from current, voltage, and/or other sensors on or within the power storage system 16, such as to receive information about the voltage, current, and temperature of each battery cell or group of battery cells within the power storage system 16. For example, the battery controller 20 may receive inputs from one or more sensors within the power storage system 16, such as a voltage, current, and temperature sensors for the power storage system 16. Voltage sensors may be configured to sense voltage within the battery (such as cell voltage sensors configured to sense the voltage of individual cells or groups of cells in a LI battery), and one or more temperature sensors may be configured to sense a temperature within a housing of the power storage device where one or more batteries or other storage elements are located. The battery controller 20 or other controller in the system is configured to calculate a charge level, such as a state of charge, of the power storage system 16.

A control system 11 controls the electric marine propulsion system 2, wherein the control system 11 may include a plurality of control devices configured to cooperate to provide the method of controlling the electric marine propulsion system described herein. For example, the control system 11 includes a power controller 12, the battery controller 20, and one or more motor controllers, trim controllers, steering controllers, etc. communicatively connected, such as by a communication bus. With continued reference to FIG. 1, the power controller 12 is configured to receive information from at least one sensor for sensing conditions of the battery storage system 16. For example, the power controller 12 (and/or any other controller, such as the battery controller 20) is communicatively connected to a plurality of battery area sensors positioned on and around the external housing(s) of the cell packs, which are positioned in the hull of the vessel and configured to sense the presence of water and gasses in the area of the separately-housed cell packs that are distributed around the vessel. The battery area sensors include, for example, at least one battery area temperature sensor 94, at least one high water sensor 91, at least one low water sensor 92, at least one gas sensor 93, and at least one orientation sensor 56 (e.g., an accelerometer). The power controller 12 is configured to utilize data received from at least one of the sensors 56, 91-94 to identify various battery conditions or events, for example a submersion event, an inversion event, and/or a thermal event. The control system 11 may then perform a corresponding mitigation action in response the detected condition or event.

A person of ordinary skill in the art will understand in view of the present disclosure that other control arrangements could be implemented and are within the scope of the present disclosure, and that the control functions described herein may be combined into a single controller or divided into any number of a plurality of distributed controllers that are communicatively connected. Each controller may comprise a processor and a storage device, or memory, configured to store software and/or data utilized for controlling and/or tracking operation of the electric propulsion system 2. The memory may include volatile and/or non-volatile systems and may include removable and/or non-removable media implemented in any method or technology for storage of information. The storage media may include non-transitory and/or transitory storage media, including random access memory, read only memory, or any other medium which can be used to store information and be accessed by an instruction execution system, for example. An input/output (I/O) system provides communication between the control system 11 and peripheral devices.

Each electric motor 4 may be associated with a motor controller 14 configured to control power to the electric motor, such as to the stator winding thereof. The motor controller 14 is configured to control the function and output of the electric motor 4, such as controlling the torque outputted by the motor, the rotational speed of the motor 4, as well as the input current, voltage, and power supplied to and utilized by the motor 4. In one arrangement, the motor controller 14 controls the current delivered to the stator windings via the leads, which input electrical energy to the electric motor to induce and control rotation of the rotor. In certain embodiments, various sensing devices 23-25, 26, and 28-29, may be configured to communicate with a local controller, such as the motor controller 14 or battery controller 20, and in other embodiments the sensors 23-25, 26, and 28-29 may communicate with the power controller 12 and one or more of the motor controller 14 and or battery controller 20 may be eliminated. The controllers 12, 14, 20 (and/or the various sensors and systems) may be configured to communicate via a communication bus such as a CAN bus or a LIN bus, or by single dedicated communication links 34 between controllers 12, 14, 20.

Upon connecting the one or batteries to power the marine vessel electrical system, sensors may be configured to sense the power, including the current and voltage, delivered to the marine vessel electrical system and the motor 4. For example, a voltage sensor 29 may be configured to sense the input voltage to the motor 4 and a current sensor 28 may be configured to measure input current to the motor 4. Accordingly, power delivered to the motor 4 can be calculated and such value can be used for monitoring and controlling the electric propulsion system 2, including for monitoring and controlling the motor 4. In the depicted example, the voltage sensor 29 and current sensor 28 may be communicatively collected to the motor controller 14 to provide measurement of the voltage supplied to the motor and current supplied to the motor 4. The motor controller 14 is configured to provide appropriate current and/or voltage to meet the demand for controlling the motor 4. For example, a demand input may be received at the motor controller 14 from the power controller 12, such as based on an operator demand at a helm input device, such as the throttle lever 38. In certain embodiments, the motor controller 14, current sensor 28, and voltage sensor 29 may be integrated into a housing of the electric motor 4, in other embodiments the motor controller 14 may be separately housed.

In one embodiment, the power controller 12 communicates with the motor controller 14 via communication link 34, such as a CAN bus. The controller also receives input from and/or communicates with one or more user interface devices in the user interface system via the communication link, which in some embodiments may be the same communication link as utilized for communication between the controllers 12, 14, 20 or may be a separate communication link. A steering wheel is provided, which in some embodiments may communicate with the controller 12 to effectuate steering control over the marine drive 3, which is well-known and typically referred to as steer-by-wire arrangements. Various steer arrangements, such as various steer-by-wire arrangements and/or mechanically connected steering arrangements, are well-known in the art and could alternatively be implemented.

The power storage system 16 may be configured to power auxiliary devices 60 on the marine vessel that are not part of the propulsion system 2. For example, the auxiliary devices may include a bilge pump, a cabin lights, a stereo system or other entertainment devices on the vessel, a water heater, a refrigerator, an air conditioner or other climate/comfort control devices on the vessel, communication systems, navigation systems, or the like. Some or all of these accessory devices are sometimes referred to as a "house load" and may consume a substantial amount of battery power. For example, the house load may include elements and helm devices such as the throttle lever 38, steering 42, the joystick 44, and a user interface 35 (e.g., including a display such as a multifunction display ('MFD')) (see, e.g., FIG. 3). The display may include any form of display, not only an MFD. Collectively, the auxiliary devices 60, the electric motor 4, and/or any other systems or devices on the marine vessel 1 requiring electrical power make up the electrical load for which the power storage system 16 provides electrical power.

The control system 11 is configured to use switches to disconnect the marine vessel electrical system from the batteries, and vice versa, for example in response to a submersion or inversion event. Each switch may be any of various switch arrangements and configurations, such as a MOSFET configured to operate as a switch or physical contactors. The sets of switches are connected between the marine vessel electrical system and the batteries so as to selectively electrically connect and disconnect the marine vessel electrical system to/from the batteries. The switches may be configured to permit connection of one or a plurality of batteries and may be configured to allow connection and disconnection of batteries together as a unit or individually.

Figure 2:
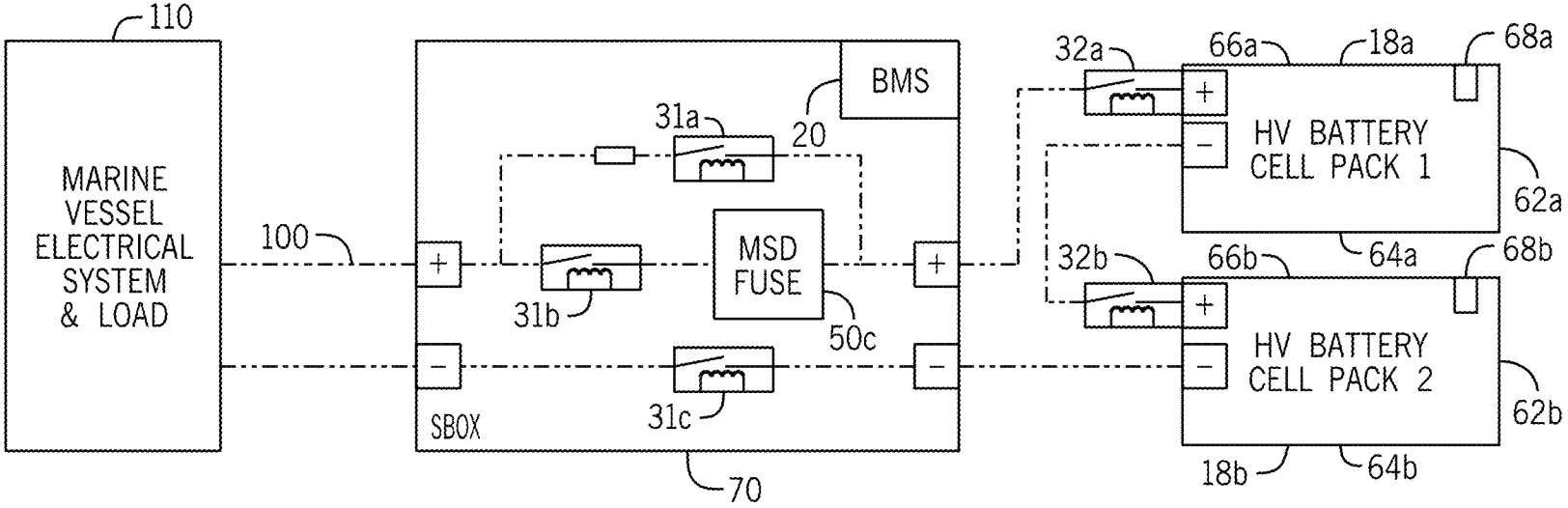
FIG. 2 is a schematic of another exemplary high voltage system for a marine vessel in accordance with the present disclosure.

In some embodiments, the switches that isolate the marine vessel electrical system are located between the batteries and the components requiring electrical power (i.e., the electrical load). For example, referring now to FIG. 2, load connection switches 31*a*, 31*b*, 31*c* may be located in a switchbox ('SBox') 70. The illustrated SBox 70 is located between the electrical system and load 110 of the marine vessel 1 and a first high voltage battery cell pack 18*a* and a second high voltage battery cell pack 18*b*, each of which comprises a plurality of individual battery cells. Each battery cell pack 18*a*, 18*b* includes a housing 62 with a lower side 64, an upper side 66, and a vent 68, such as a Gortex covered vent, located proximate the upper side 66 and configured to allow the battery cell pack assembly to breathe while preventing water ingress. Current battery certification standards, such as IP69k Certification Standards, require that the pack enclosure, all interconnects, and the venting system do not allow any liquid ingress for a certified time and depth. IP69K certification involves submersion of a battery pack assembly at peak operating temperature to a depth of 2 m for a defined period (typically 2 hours) and vigorous close range power washing of all interconnects with 15000 psi water or steam. However, when a battery pack of normal operating temperature is immersed in liquid (typically water), the pack assembly is cooled, creating a vacuum that will compromise the IP69K waterproof rating. The waterproofing will be compromised more quickly at greater depths, where appreciable pressure is incurred, and thus both pressure and time of exposure are factors that must be considered when monitoring an immersed battery.

The high voltage battery cell packs 18*a*, 18*b* are connected in series between positive and negative terminals of the SBox 70, and a battery connection switch 32*a*, 32*b* is connected to a terminal of each high voltage battery cell packs 18*a*, 18*b*. The battery connection switched 32*a*, 32*b* may be configured as high voltage contactors 32*a*, 32*b* that connect the high voltage battery cell packs 18*a*, 18*b*, which are arranged in series, to an output connection attachable to a load on the marine vessel, such as the motor 4. The battery connection switches 32*a*, 32*b* may be controlled, for example by the battery controller 20 and/or the power controller 12 (FIG. 3), to operate as disconnect switches switchable between open and closed positions in order to disconnect or connect the high voltage battery cell packs 18*a*, 18*b* from the SBox 70. In some arrangements, the SBox 70 may include one or more manual service disconnections 50*c* to further isolate the marine vessel electrical system and/or the batteries.

In some embodiments, the control system may open and/or close the load connection switches 31*a*, 31*b*, 31*c* to control isolation of the marine vessel electrical system and/or the batteries to test both separately to confirm electrical isolation, for example as disclosed in U.S. patent application Ser. No. 18/441,895, filed Feb. 14, 2024.

Figure 3:
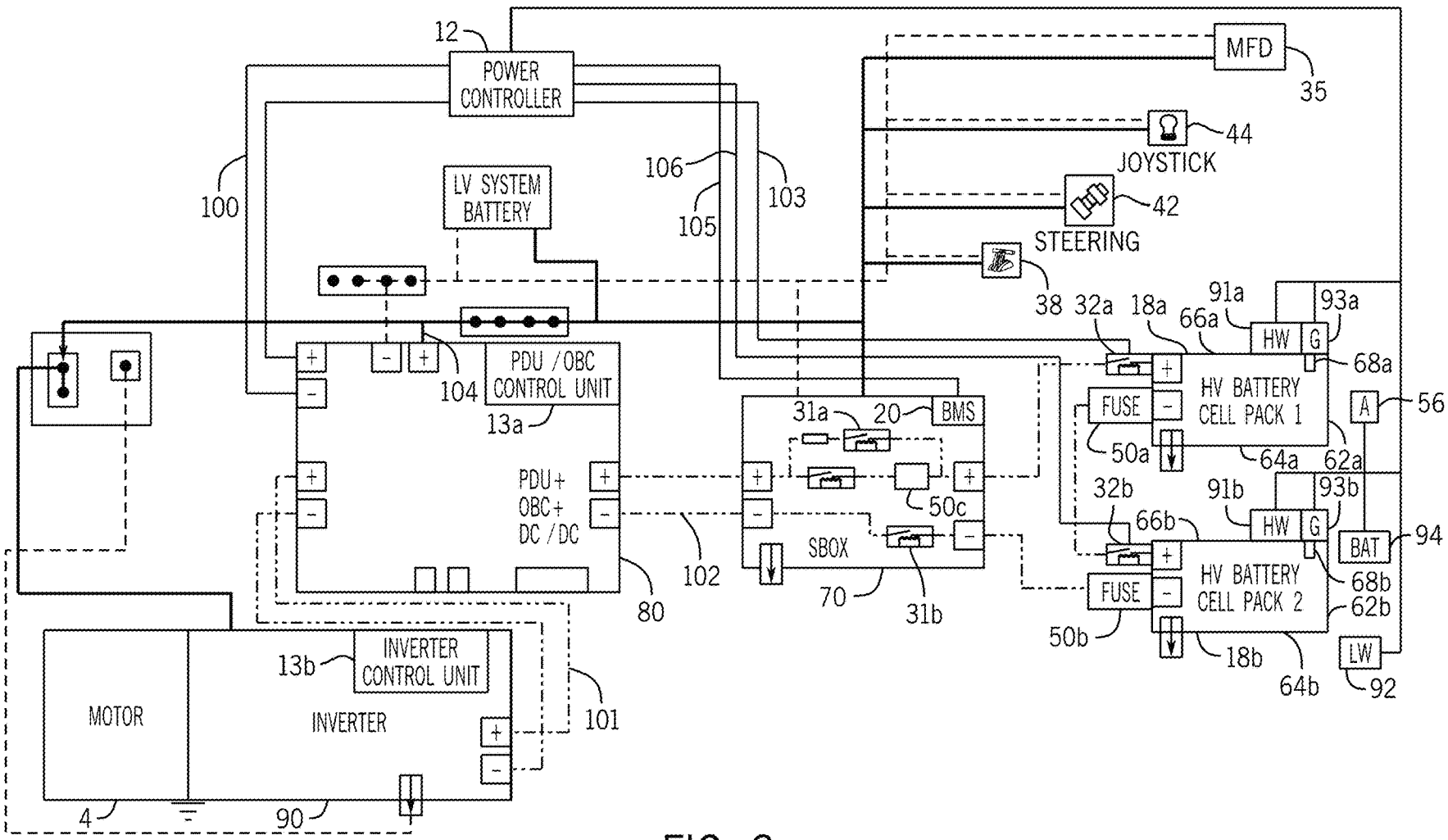
FIG. 3 is a schematic of another exemplary high voltage system for a marine vessel in accordance with the present disclosure.

Referring now to FIG. 3, the power controller 12 may control all operations of the switches 31*a*, 31*b*, 32*a*, 32*b* as well as the service disconnect fuses 50*a*, 50*b*, 50*c* and other connection control elements from a single, centralized location—the power controller 12. In one embodiment, the power controller 12 may control the switches within the high voltage system and may open and/or close one or more switches to disconnect and isolate the high voltage battery cell packs 18*a*, 18*b* in response to sensor readings and/or the detection of an immersion and/or inversion event.

When the load connection switches 31*a*, 31*b* are closed, current travels from the SBox 70 to the Power Distribution Unit ('PDU') 80 via circuit lines 102, where the power is then distributed to peripheral components of the marine vessel electrical system, such as an inverter 90, a motor, auxiliary devices, and/or a 'house load' via other circuit lines 101. The illustrated embodiment is meant only to be exemplary, with the same procedure remaining applicable to marine electrical systems where the SBox 70 is operably the same device as the PDU 80 and/or where the PDU 80 is connected to an On-Board Charger ('OBC') (as illustrated). In some embodiments, the control system may include a power controller 12 within the PDU 80 that controls the marine vessel electrical system. In embodiments where the inverter 90 supplies power to a motor, the inverter 90 may be inside or outside of the motor.

In one embodiment, the power controller 12 may control various operations of the marine vessel electrical system via one or more auxiliary controllers 13*a*, 13*b*, which may execute instructions for a corresponding portion of the marine vessel electrical system and relay and relevant information to the power controller 12. Instructions from the power controller 12 may be received by the auxiliary controllers 13*a*, 13*b* which may be provided a limited or minimal supply of power, for example by an OBC. In one embodiment, the OBC may provide voltage from the PDU 80 to various portions of the electrical system via direct or indirect circuit lines 101, 102, 104, 105. Additionally or alternatively, the power controller 12 may directly control switches through circuit lines 103, 106 from the power controller 12 to the battery connection switches 32*a*, 32*b*. Similarly, the power controller 12 may control a set of switches 31*a*, 31*b* through a common circuit junction, such as the SBox 70. In some arrangements, the high voltage control system may include one or more fuses or manual service disconnects ('MSD') 50*a*, 50*b*, 50*c* to further isolate the marine vessel electrical system and/or the batteries to electrically isolate the batteries as part of the ingress mitigation action.

As previously mentioned, the electrical control system 11 of the marine vessel 1 is configured to detect various adverse battery events and generate corresponding mitigation actions using data sensed by a plurality of external sensors 56, 91-94 of the battery storage system. For example, the power controller 12 may receive inputs from one or more exterior sensors on or near an enclosure of the high voltage battery cell packs 18*a*, 18*b*. The exterior sensors may include at least one exterior water sensor 91, 92 configured to sense the presence of water on the exterior of the enclosure. In the illustrated embodiments, the control system 11 includes a plurality of high water sensors 91*a*, 91*b* and at least one low water sensor 92. The low water sensor 92 may be positioned at the lowest point of the marine vessel 1 occupied by at least one of the high voltage battery cell packs 18*a*, 18*b*. For example, a low water sensor 92 may be positioned proximate (or below) the lower side 64*a*, 64*b* of the high voltage battery cell pack 18*a*, 18*b* that is at the lowest position in the marine vessel 1 relative to the other high voltage battery cell pack(s) 18*a*, 18*b*. This may be useful, for example, to determine that at least one high voltage battery cell pack 18*a*, 18*b* has been exposed to water. In some embodiments, a low water sensor 92 may be configured as a floatation-triggered switch, such as a floatation-type bilge switch, that triggers when a floating element thereof is floated upwards when exposed to water. Advantageously, a flotation-type water sensor 92 may be configured such that it does not draw power when no water is present.

In some embodiments, a control system 11 may include a plurality of low water sensors 92 arranged at different locations relative to the battery cell packs 18*a*, 18*b*. This may be useful, for example, to detect a low water condition in a marine vessel 1 in which the battery cell packs 18*a*, 18*b* are distributed longitudinally between the bow and stern and/or laterally between the port and starboard sides thereof. Low water sensors 92 may be distributed in the marine vessel 1 so that a low water level can be detected in different orientations of the marine vessel 1. For example, a plurality of low water sensors 92 may be distributed laterally and/or longitudinally in a marine vessel 1 such that the low water sensors 92 can sense the presence of water when the marine vessel 1 is listing or heeling, if the marine vessel 1 is stored in an angled orientation, and/or if the marine vessel 1 becomes inverted. In some embodiments, multiple low water sensors 92 may be arranged around multiple sides of one battery cell pack 18*a*, 18*b* in order to sense water approaching the battery cell pack 18*a*, 18*b* from different lateral and/or longitudinal directions.

Each high voltage battery cell packs 18*a*, 18*b* may be configured with a high water sensor 91*a*, 91*b* positioned on the upper side 66*a*, 66*b* on the exterior housing 62*a*, 62*b* of the battery cell pack 18*a*, 18*b* above the low water sensor 92. For example, a first high water sensor 91*a* is at or near a high point of the external housing 62*a* of the first battery cell pack 18*a* and the second high water sensor 91*b* is at or near a high point of the external housing 62*b* of the second battery cell pack 18*b*. At least one of the high water sensors 91*a*, 91*b* may be positioned proximate a potential leak point on the corresponding cell pack housing 62*a*, 62*b*. For example a high water sensor 91*a*, 91*b* may be positioned at or near the housing vent 68*a*, 68*b*, a joint and/or seal of the housing 62*a*, 62*b*, a pressure release valve of the housing 62*a*, 62*b*, and/or any other location where water may potentially enter into one of the housings 62*a*, 62*b*. This may be useful, for example, to monitor locations on the high voltage battery cell packs 18*a*, 18*b* which are susceptible to leaks should a submersion event occur.

In some embodiments, a plurality of high water sensors 91 may positioned on the housing 62*a*, 62*b* of at least one of the battery cell packs 18*a*, 18*b*. The plurality of high water sensors 91 may be positioned proximate different potential leak points on the housing 62*a*, 62*b*. Additionally or alternatively, the plurality of high water sensors 91 on battery cell pack 18*a*, 18*b* may be distributed vertically between the upper side 66 and the lower side 64 of the housing 62 or horizontally around the housing 62 of said battery cell pack 18*a*, 18*b*. This may be useful, for example to determine how much and/or which portions of a battery cell pack 18*a*, 18*b* has been exposed to water. High water sensors 91 may be arranged on a battery cell pack 18*a*, 18*b* so that water levels may be measured in different orientations of the marine vessel 1. For example, a plurality of high water sensors 91 may be distributed on a battery cell pack 18*a*, 18*b* such that the high water sensors 91 can accurately measure the water level relative to said battery cell pack 18*a*, 18*b* when the marine vessel 1 is listing or heeling, if the marine vessel 1 is stored in an angled orientation, and/or if the marine vessel 1 becomes inverted. In one embodiment, at least one of the high and low water sensors 91, 92 may be a capacitive water sensor. Alternatively, at least one of the high and low water sensors 91, 92 may be a resistive sensor, a thermal sensor, and/or a flotation-type switch configured to detect contact with water.

Alternatively or additionally, the exterior sensor(s) may include one or more of a battery area temperature sensor 94 configured to sense an external temperature on the cell pack enclosure or a temperature of the environment surrounding the cell pack enclosure, and/or at least one of gas sensor 93*a*, 93*b* configured as a gas sensing electrodes configured to sense the presence of a volatile organic compound (VOC) gas, CO2, CO, H2, and/or electrolyte gas or vaporized electrolyte indicating that electrolysis is occurring, which may be indicative of a thermal event. In the illustrated embodiments, a gas sensor 93*a*, 93B is positioned proximate the vent 68*a*, 68*b* on the housing 62*a*, 62*b* of each high voltage battery cell pack 18*a*, 18*b* so that the gas sensors 93*a*, 93*b* can effectively sense the emission of gas(es) indicative of a thermal event from the vents 68*a*, 68*b*. For example, in some embodiments, the gas sensors 93*a*, 93*b* may be positioned within less than a foot of the vent 68*a*, 68*b*, such as within a few inches or within 10 cm of the vent 68*a*, 68*b*. The gas sensors 93*a*, 93*b*, may be mounted to the external housings 62*a*, 62*b* of the battery cell packs 18*a*, 18*b* at the area of the vent 68*a*, 68*b*. Additionally or alternatively, at least one gas sensor 93, may be attached to a portion of the frame connecting the housing 62*a*, 62*b* of a battery cell pack 18*a*, 18*b* to the marine vessel 1 or to a portion of the hull adjacent to the vent 68*a*, 68*b*. In some examples, the electrical control system 11 may be configured with multiple water sensors 91, 92, temperature sensors 94, and/or gas sensors 93, such as positioned on multiple sides of the battery cell pack housing(s) 62 to provide information regarding different portions of the high voltage battery cell pack(s) 18*a*, 18*b*. For example, a marine vessel 1 may include multiple low water sensors 92 located proximate battery cell packs which are at different locations in the hull of the marine vessel 1. This may be useful, for example, if at least one high voltage battery cell pack is positioned higher than another high voltage battery cell pack.

The electrical control system 11 is configured to determine a battery state of health and to recognize a hazardous condition based on any one or more of the and exterior sensor 56, 91-94 measurements. For example, the state of health may be determined based on measured temperature and/or rate of internal temperature rise, gas emissions, battery orientation, G-levels endured, water exposure and/or the duration thereof, etc. The power controller 12 (and/or the battery controller 20 or a sensor processor module) may be configured to recognize a hazardous condition of the marine battery based on the sensed values, such as by comparing each or a subset of the sensed values to threshold values or threshold change values. For instance, the power controller 12 may be configured to receive sensor data from the exterior sensors 56, 91-94 and to detect conditions indicating immersion of a high voltage battery cell pack 18*a*, 18*b* and to activate a shock hazard response or other protective response for the battery cell pack(s) 18*a*, 18*b*.

The battery connection switches 32*a*, 32*b* may be controllable, such as by the power controller 12, to disconnect the high voltage battery cell packs 18*a*, 18*b* from the electrical system. For example, one or more battery connection switch(es) 32*a*, 32*b* may be placed between the series of high voltage battery cell packs 18*a*, 18*b* and the SBox 70. When the battery connection switch(es) 32*a*, 32*b* are opened, the high voltage battery cell packs 18*a*, 18*b* are disconnected from the SBox 70 and thus disconnected from the load and isolated from the electrical load and other portions of the marine vessel electrical system.

If abnormal conditions are detected on or within the at least one of the high voltage battery cell packs 18*a*, 18*b* warranting disconnection of the battery cell packs 18*a*, 18*b* from the load, such as the detection of a submersion event, then battery connection switch 32*a*, 32*b* (and/or the load connection switches 31*a*, 31*b* or MSDs 50*a*-50*c*) may be opened to disconnect the high voltage battery cell packs 18*a*, 18*b* from the electrical system. In certain embodiments, the connection switches 31*a*-32*b* may be resettable by a user via a switch control user interface configured to allow the switch(es) 31*a*-32*b* to be closed and reset by a user. In other embodiments, resetting the switch(es) 31*a*-32*b* to reconnect the high voltage battery cell packs 18*a*, 18*b* requires a service technician to replace the switch(es) 31*a*-32*b* once the disconnection is triggered. Likewise, the MSDs 50*a*, 50*b* may be configured to, once opened, require service by a technician to make the system operable again.

In some embodiments, the power controller 12 may be configured to communicate with the user interface system 35 and/or to control one or more alert devices on the battery cell pack enclosure to provide warnings to a user regarding a submersion event and/or the status of the automatic shock reduction response. For example, in a situation where the operator inadvertently launches the boat with the drain plug removed, the system may be configured to provide warning to a user of detected water. For example, the system may be configured to open the battery connection switch(es) 32*a*, 32*b* and to generate a water exposure alert to advise the user of the water in the hull, such as before performing any automatic response requiring service by a technician to repair, to provide a stepped response to battery pack water immersion.

The power controller 12 may be configured to communicate with or control an alert system, which may be integrated with the user interface system 35 of the vessel. The power controller 12 may be configured to communicate with the alert system via communication link, such as a CAN bus. For example, a water exposure alert may be provided on the display of the user interface system 35 advising the user of the unsafe condition and providing an instruction to call for help and/or return home. Alternatively or additionally, an auditory alert may be provided. Alternatively or additionally, an alert may be provided on a remote user interface system, such as on a user's portable computing device that is communicatively connected with the user interface system 35 and/or the alert system. For example, the user interface system 35 may incorporate VesselView Mobile™ provided by Mercury Marine and configured to enable battery state of health and/or other battery-related alerts, including a water exposure alert.

In some embodiments, a low water sensor 92 may be configured as a wakeup switch that triggers the wakeup of the power controller 12 in response to the detection of water. In some situations, the power controller 12 may be configured to enter into an inactive or standby state in which the power controller 12 has reduced power consumption or does not consume any power. This may be useful, for example, in order to conserve power when the marine vessel is in storage and/or is otherwise inactive. The low water sensor 92 may be configured to complete a circuit and/or send a wakeup signal to the power controller 12 when water is detected, for example if the marine vessel 1 begins taking on water while not in use at a dock, or if an inversion event occurs while the marine vessel 1 is in storage. Once woken up by the low water sensor 92, the power controller 12 can begin monitoring for submersion events, for example using the water sensor(s) 91, 92, the gas sensor(s) 93, the battery area temperature sensor(s), and or any other sensors or data available to the power controller 12.

As previously mentioned, embodiments of a marine vessel 1 may be configured with a plurality of separate high voltage battery cell packs 18 that are individually mounted thereon. For example, referring also to FIG. 4, some embodiments may include at least one high voltage battery cell pack 18*c* that is mounted on the hull (not shown) of a marine vessel 1, separate from the other high voltage battery cell pack(s) 18, via a mounting assembly 150. The battery cell pack 18*c* includes an external housing 62*c* that encloses the plurality of battery cells (not shown) of the battery cell pack 18*c*. The high voltage system includes a plurality of battery cell packs 18, of which the battery cell pack 18*c* is one. Each of the plurality of battery cell packs 18 is heavy and thus the cell packs 18 may be spread around the hull of the vessel for weight balancing and based on space constraints.

The mounting assembly 150 for each cell pack 18 includes at least one mounting rail 152 coupled to the hull (or other part) of the marine vessel 1 and extending below the housing 62*c*. The battery cell pack 18*c* is supported on the mounting rail(s) 152 by at least one isolating support 154 configured to vibrationally and/or electrically isolate the battery cell pack 18*c* from the hull of the marine vessel 1 and any other battery cell pack(s) 18 on the marine vessel 1. The mounting assembly 150 of FIG. 4 (as well as differently configured mounting arrangements) advantageously allows a user or manufacturer to mount individual battery cell packs 18 to the marine vessel 1 in any desired arrangement. Battery cell packs 18 may be distributed asymmetrically on the marine vessels 1, for example in order to achieve a balance with other components of the marine vessel 1. Additionally or alternatively, a battery cell pack 18 may be modularly connected to a marine vessel 1.

Figure 4:
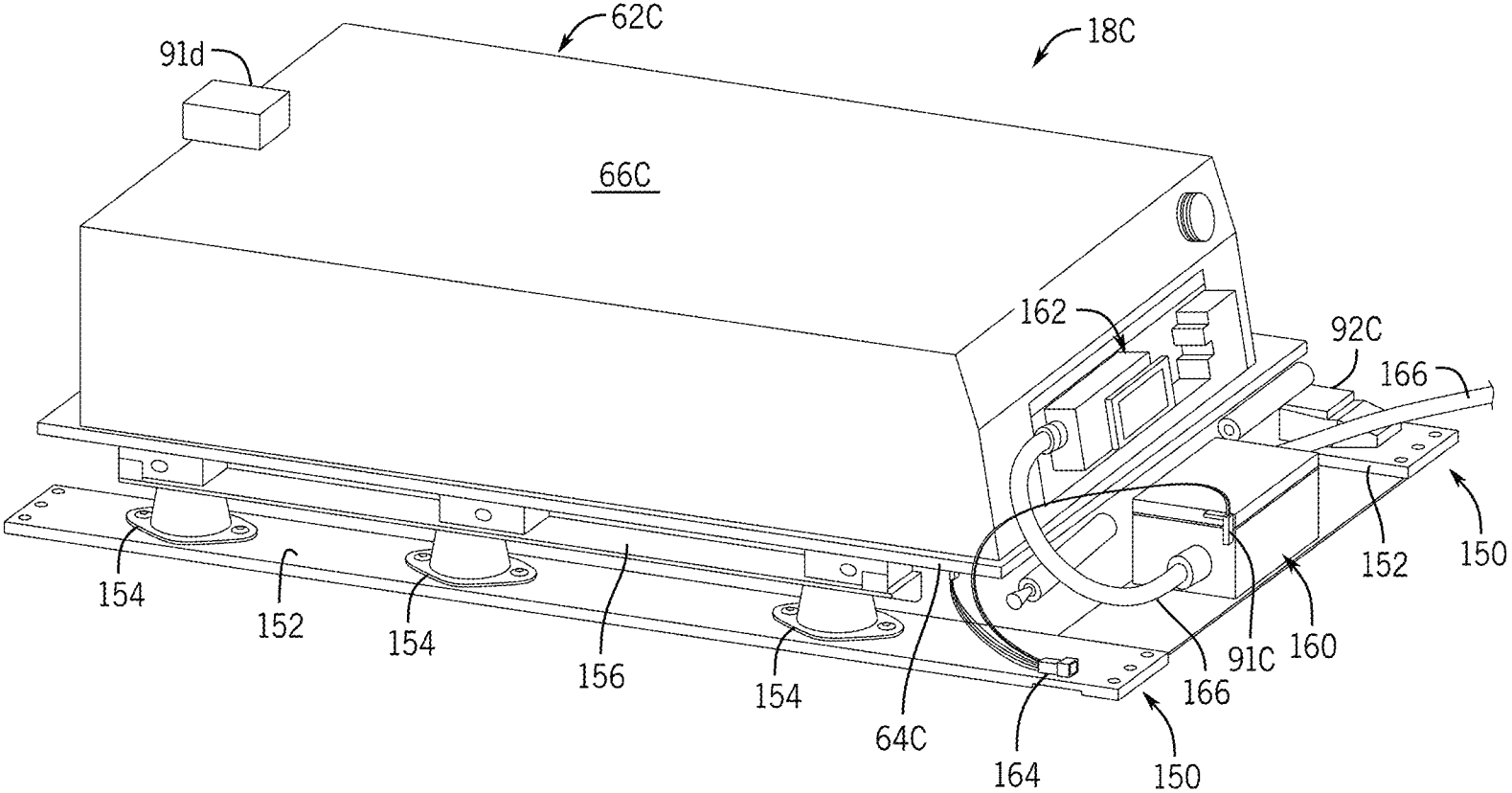
FIG. 4 is a perspective view of an exemplary high voltage battery cell pack for an exemplary high voltage system with a mounting assembly for separately supporting the high voltage battery cell pack on a marine vessel.

In the illustrated embodiment, the battery cell pack 18*c* of FIG. 4 is supported by two opposing mounting rails 152 that extend along opposing lateral sides of the external housing 62*c*. Three isolating supports 154 configured as resiliently deformable vibration dampening supports 154 connect each mounting rail 152 to a corresponding support rail 156 formed along the lower side 64*c* of the housing 62*c* proximate the lateral sides thereof. Sone embodiments, however, may include a different mounting arrangement for separately supporting at least one high voltage battery cell pack 18 on the marine vessel. 1 Electrical current may be supplied to the battery cell pack 18*c* via at least one electrical connector 166 extending between the battery cell pack 18*c*, the SBox 70, and/or any other intermediate components. For example, in FIG. 4 high voltage electrical connectors 166 extend between a connection enclosure 162 on the external housing 62*c* and a sealed enclosure 160 on the mounting assembly 150 (and/or the vessel's hull), and between the sealed enclosure 160 and the SBox 70 (see, e.g., FIGS. 2 and 3). In some embodiments, the sealed enclosure 160 and connection housing 162 may be configured to house at least one of the battery connection switch and the fuse (see, e.g., FIG. 3) for the battery cell pack 18*c*.

With continued reference to FIG. 4, the control system includes a low water sensor 92*c* and two high water sensors 91*c*, 91*d* configured to sense the presence of water proximate the battery cell pack 18*c*. The low water sensor 92*c* is mounted on one of the mounting rails 152 below the lower side 64*c* of the external housing 62*c* and may be configured to sense, for example, a low water condition at the battery cell pack 18*c*. A first high water sensor 91*c* is configured to be mounted on or near the sealed enclosure 160 or the connection enclosure 162 such that it is between the lower side 64*c* and the upper side 66*c* of the external housing 62*c*. This may be useful, for example, to sense water near possible leak points into the external housing 62*c* and/or other enclosures 160, 162 configured to house electrical components. A second high water sensor 91*d* is configured to be mounted on the upper side 66*c* of the external housing 62*c*. Advantageously, the use of multiple high water sensors 91*c*, 91*d* for a battery cell pack 18*c* allows the control system to sense different water levels relative to the external housing 62*c* of said a battery cell pack 18*c*. In the illustrated embodiment, the second high water sensor 91*d* is positioned on the upper side 66*c* proximate a side of the housing 62*c* that is opposite the connection enclosure 162. Additionally or alternatively, some embodiments may include at least one high water sensor 91 positioned proximate the connection enclosure 162.

Various sensing analysis methods to detect that the battery pack has been exposed to and/or immersed in water are disclosed herein and may be executed by the power controller 12 to detect a submersion event. If a submersion event is detected, then one or more electrical connections within the pack may be adjusted to reduce the shock hazard posed by the battery. In certain embodiments, the shock hazard reduction may be performed in stages based on the sensed conditions, so as to avoid unnecessarily disabling the battery system and/or inconveniencing the user more than necessary to sufficiently reduce the hazard.

Figure 5:
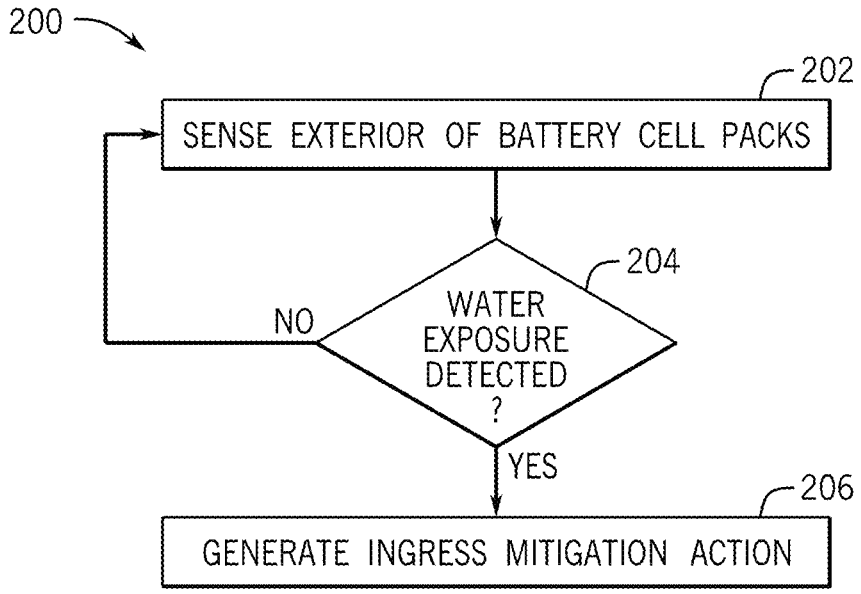
FIGS. 5-7 illustrate exemplary methods for controlling high voltage system for a marine vessel in accordance with the present disclosure.
Figure 6:
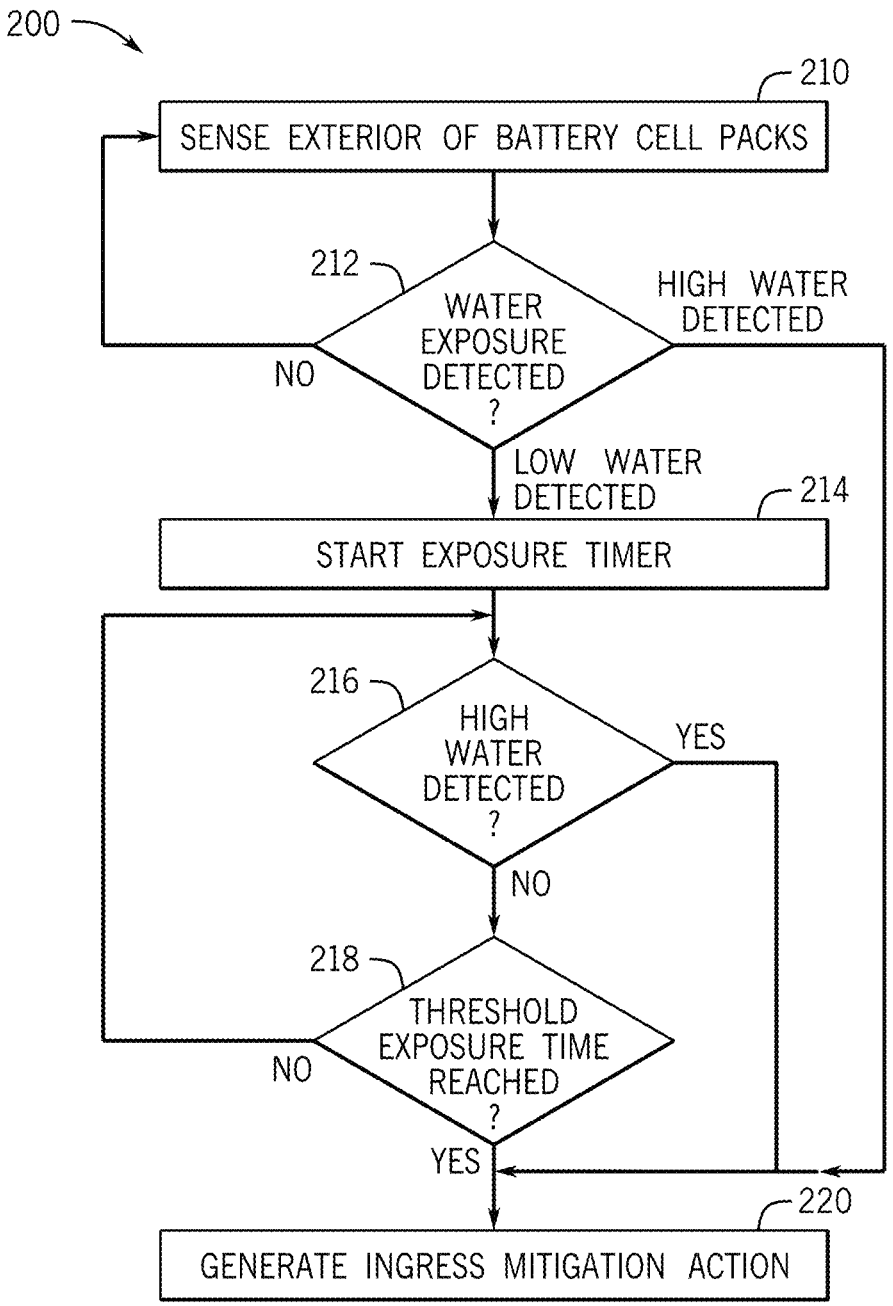

FIGS. 5-6 depict methods 200 of controlling a power system 11 for a marine vessel 1 exemplifying embodiments of exterior water exposure event detection and response under various conditions in which the marine vessel 1 is in an upright orientation. In FIG. 5, a method 200 of controlling a power system 11 for a marine vessel 1 includes sensing for the presence of water proximate at least on high voltage battery cell pack 18*a*, 18*b* at step 202 via one or more water sensors 91*a*, 92*b*, 92. Sensed data from the water sensors 91*a*, 92*b*, 92 is communicated to the power controller 12 and used to determine if a submersion event has occurred at step 204. In some embodiments, a submersion event is detected when water is sensed by one or more of the water sensors 91*a*, 91*b*, 92. For example, a submersion event may be detected in response to the detection of water by at least two of the low water sensor 92, the first high water sensor 91*a*, and the second high water 91*b*. In some embodiments, a submersion event is detected when water is sensed by the low water sensor 92 and at least one of the high water sensors 91*a*, 91*b*.

Additionally or alternatively, a submersion even may be detected at step 204 in response to the detection of gas emissions from a battery cell pack 118*a*, 118*b* by the first gas sensor 93*a* and/or the second gas sensor 93*b*. For example, measured values from one or more gas sensor 93*a*, 93*b* are compared to a threshold to determine whether an amount of electrolysis gas is corresponds to a thermal runaway event in a battery cell pack 18*a*, 18*b*, which is indicative of a submersion event. A thermal event indicative of a submersion event may additionally or alternatively be detected using temperature readings from the battery area temperature sensor 94. Thus, a submersion event may be detected based on temperature measurements from the battery area temperature sensor 94.

If a submersion event is detected at step 204 based on the sensed values, such as based on a sensed battery area temperature, the detection of electrolyte gasses, and/or a detected presence of water on the exterior of a battery cell pack housing 62*a*, 62*b*, then an ingress mitigation action is generated at step 206. The ingress mitigation action may include generating a water ingress alert, such as a visual alert and/or an auditory alert, generated on a user interface 35 to advise a user that the battery enclosure has been exposed to water. Alternatively or additionally, the ingress mitigation action may include adjusting at least one electrical connection in the between the electrical system and the battery cell packs 18*a*, 18*b* to reduce a shock hazard. For example, an ingress mitigation action may include controlling the first battery connection switch 32*a* to disconnect the first high voltage battery cell pack 18*a* from the electrical system and/or controlling the second battery connection switch 32*b* to disconnect the second high voltage battery cell pack 18*b* from the electrical system.

In some embodiments, the ingress mitigation action generated at step 206 may include controlling the electrical load(s) of the marine vessel (e.g., the motor and/or other auxiliary devices 60) to stop power draw from the high voltage battery cell packs prior to controlling the first battery connection switch 31*a* to disconnect the first battery cell pack 18*a*, and controlling the second battery connection switch 31*b* to disconnect the second battery cell pack 18*b*. For example, the ingress mitigation action may include executing an automatic shutdown of the electric motor 4 to stop power draw by the motor 4 from the battery cell packs 18*a*, 18*b*. Additionally or alternatively, the ingress mitigation action may include controlling at least one fuse 50*a*, 50*b* connected to a battery cell pack 18*a*, 18*b* (and/or the MSD 50*c* in the SBox 70) to disconnect the electrical load of the marine vessel 1 from the plurality of battery cell packs 18*a*, 18*b*.

In some embodiments, a marine vessel 1 may be configured with a battery cooling system for cooling at least one of the high voltage battery cell packs 18*a*, 18*b*. For example, a first battery cooling system (not shown) may be configured to cool the first battery cell pack 18*a* and a second battery cooling system (not shown) may be configured to cool the second battery cell pack 18. In such an embodiment, generating the ingress mitigation action at step 206 may include increasing the cooling activity of at least one of the first battery cooling system or the second battery cooling system. In some embodiments, the cooling activity of the first battery cooling system may be increased when a submersion event is detected using the first high water sensor 91*a* and/or the first gas sensor 93*a* and the cooling activity of the second battery cooling system may be increased when a submersion event is detected using the second high water sensor 91*b* and/or the second gas sensor 93*b*.

In some embodiments, a submersion event may be detected in response to the detection of water by a water sensor 91*a*, 91*b*, 92 for a predetermined amount of time. For example, in FIG. 6, a method 200 of controlling a power system 11 for a marine vessel 1 includes sensing the presence of water proximate at least on high voltage battery cell pack 18*a*, 18*b* at step 210 via one or more water sensors 91*a*, 92*b*, 92. If the presence of water is sensed by the first high water sensor 91*a* and/or the second high water sensor 91*b* at step 212, the power controller 12 may proceed to generate an ingress mitigation action at step 220.

If the presence of water is sensed by the low water sensor 92 but not the high water sensors 91*a*, 91*b* at step 212, an exposure timer measuring the duration of time for which the low water sensor 92 is exposed to water is started at step 214. While the exposure timer is running, the high water sensors 91*a*, 92*b* may be monitored to determine if any of the battery cell packs 18*a*, 18*b* have been submerged. If water is sensed by first high water sensor 91*a* and/or the second high water sensor 91*b* at step 216 before the exposure time reaches the predetermined exposure threshold, the power controller 12 may proceed to generate an ingress mitigation action at step 220. If no water is sensed by the high water sensors 91*a*, 91*b* but water is still sensed by the low water sensor 92 after the exposure timer predetermined period of time at step 218, then an ingress mitigation action is performed at step 220. The ingress mitigation executed at step 220 may be the same or different than the ingress mitigation action performed at step 206 of FIG. 5.

As previously mentioned, the power controller 12 may be powered off or configured to remain in a standby state until water is detected by the low water sensor 92. This may be useful, for example, in order to reduce power consumption when the marine vessel 1 is in storage and/or otherwise not in use. For example, the low water sensor 92 may be configured as a float switch which powers on the power controller 12 in response to detecting water. Upon powering on, the power controller 12 is configured to execute instructions to detect the submersion event, for example the instructions discussed in reference to FIGS. 5 and 6.

Figure 7:
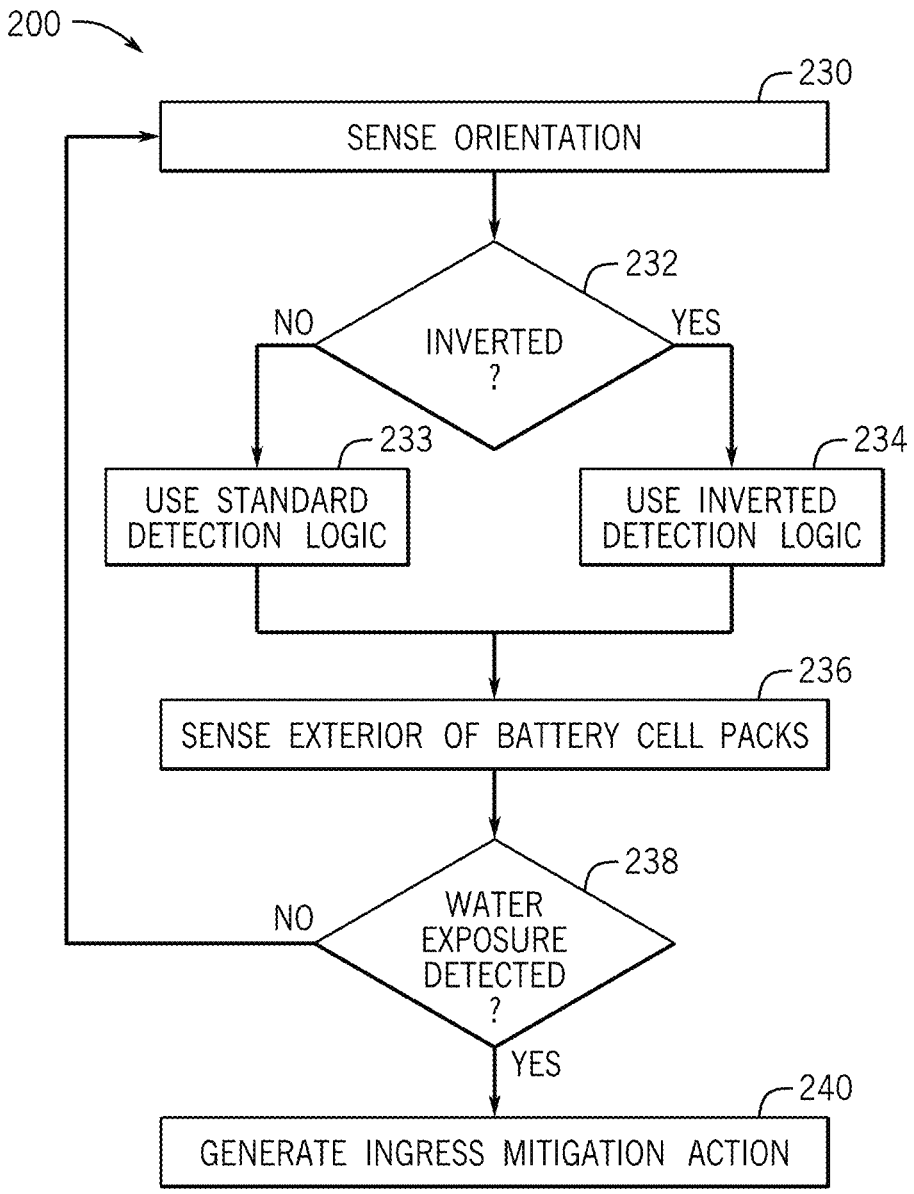

In the method 200 of FIGS. 5 and 6, steps 202, 204, 210, 212, 214, 216, 218 for detecting a submersion event are performed under the condition that the marine vessel 1 is in an upright orientation. If, however, the marine vessel 1 experiences an inversion event in which the marine vessel is at least temporarily inverted, the steps for detecting a submersion event must be performed according to a different logic corresponding to the conditions of the inversion event. FIG. 7 illustrates a method 200 of controlling a power system 11 for a marine vessel 1 which enables the control system 11 to identify a submersion event after a battery cell pack 18*a*, 18*b* has experienced an inversion event.

In the method 200 of FIG. 7, the orientation of the marine vessel 1 is sensed at step 230, for example using data from the orientation sensor 56 (e.g., an accelerometer). Based on the data from the orientation sensor 56, logic for sensing the presence of water at a battery cell pack 18*a*, 18*b* is selected at step 232. If the orientation sensor 56 senses that the marine vessel 1 is in the upright orientation, standard detection logic for sensing the presence of water is selected at step 233. According to the standard detection logic for sensing the presence of water, the power controller 12 utilizes the output of the low water sensor 92 to sense water at the low position of the battery cell packs 18*a*, 18*b* and the output of the first and second high water sensors 91*a*, 92*b*, is used to sense water at the upper sides 66*a*, 66*b* of the first and second battery cell packs 18*a*, 18*b*, respectively. Thus, when no inversion event has been detected, the power controller 12 uses the standard detection logic to sense for a submersion event at step 238.

However, if the orientation sensor 56 identifies that the marine vessel 1 has been inverted at step 232, an inversion condition is detected and the logic for detecting a submersion event via the high and low water sensors 91*a*, 91*b*, 92 is changed. For example, when an inversion event is detected, the power controller 12 is configured to use inverted detection logic in which the high water sensors 91*a*, 91*b* is operated to sense water at a low portion of the battery cell packs 18*a*, 18*b* and the low water sensor is operated to sense water at or above the upper sides 66*a*, 66*b* of the battery cell packs 18*a*, 18*b*. In systems including a low water sensor 92 configured as a float switch 92, power controller 12 is configured to interpret an OFF position (normally indicative of the absence of water) of the float switch 92 as sensing the presence of water. Correspondingly, the power controller 12 interprets an ON position of a high water sensor 91*a*, 91*b* as the detection of water at the low portion of a corresponding one of the battery cell packs 18*a*, 18*b*. The power controller 12 may take into account the number, locations, and/or orientations of the low water sensors 92 and the high water sensors 91*a*, 91*b* when identifying submersion events according to the inverted detection logic. Thus, when an inversion event has been detected at step 232, the power controller 12 uses the inverted detection logic to sense for a submersion event at step 238.

If a submersion event is detected at step 238 according to either the standard or inverted detection logic, the power controller 12 generates an ingress mitigation event at step 240.

This written description uses examples to disclose the invention and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A power system for a marine vessel, the system comprising: a plurality of battery cell packs, including at least a first battery cell pack and a second battery cell pack, each battery cell pack comprising a plurality of battery cells encapsulated in an external housing configured to be separately mounted in the hull of the marine vessel;

a vessel load powered by the plurality of battery cell packs;

a first disconnect switch positioned outside of the external housing of the first battery cell pack and configured to disconnect the first battery cell pack from the vessel load;

a second disconnect switch positioned outside of the external housing of the second battery cell pack and configured to disconnect the second battery cell pack from the vessel load;

at least one low water sensor positioned at a lowest point of the marine vessel occupied by at least one of the plurality of battery cell packs;

at least one high water sensor positioned higher on the marine vessel than the low water sensor;

at least one hardware controller configured to:

detect a submersion event based on an output of the high water sensor and an output of the low water sensor; and generate an ingress mitigation action in response to detection of the submersion event, wherein the ingress mitigation action includes controlling the first disconnect switch and the second disconnect switch.

2. The system of claim 1, wherein the low water sensor is configured to power on the at least one hardware controller when water is sensed, wherein upon powering on, the at least one hardware controller is configured to execute instructions to detect the submersion event.

3. The system of claim 2, wherein the low water sensor is a float switch.

4. The system of claim 1, wherein the ingress mitigation action includes generating a water ingress alert on a user interface device.

5. The system of claim 1, wherein the ingress mitigation action includes controlling the first disconnect switch to disconnect the first cell pack from the vessel load and controlling the second disconnect switch to disconnect the second cell pack from the vessel load.

6. The system of claim 1, wherein the ingress mitigation action includes controlling the vessel load to stop power draw from the battery cell packs prior to controlling the first disconnect switch to disconnect the first cell pack and controlling the second disconnect switch to disconnect the second cell pack.

7. The system of claim 1, wherein the vessel load comprises at least one marine drive and wherein the ingress mitigation action includes executing an automatic shut down of the marine drive to stop power draw by the marine drive from the battery cell packs.

8. The system of claim 1, wherein the ingress mitigation action includes controlling at least one fuse to disconnect the vessel load from the plurality of battery cell packs.

9. The system of claim 1, further comprising a first battery cooling system configured to cool the first cell pack and a second battery cooling system configured to cool the second cell pack, wherein the ingress mitigation action includes increasing the cooling activity of at least one of the first battery cooling system or the second battery cooling system.

10. The system of claim 1, wherein detection of the submersion event includes water being sensed by at least one of the low water sensor and the high water sensor for a predetermined exposure time.

11. The system of claim 1, wherein detection of the submersion event includes sensing water with both the low water sensor and the high water sensor.

12. The system of claim 1, wherein the at least one high water sensor comprises a plurality of high water sensors, including at least a first high water sensor on the external housing of the first cell pack and a second high water sensor on the external housing of the second cell pack; and wherein detection of the submersion event includes sensing water with at least two of the low water sensor, the first high water sensor, and the second high water sensor.

13. The system of claim 12, wherein the first high water sensor is at or near a high point of the external housing of the first cell pack and the second high water sensor is at or near a high point of the external housing of the second cell pack.

14. The system of claim 1, wherein the at least one high water sensor comprises a plurality of high water sensors on at least one of the external housing of the first cell pack or the external housing of the second cell pack, wherein detection of the submersion event includes sensing water with at least two water sensors out of the low water sensor and the plurality of high water sensors.

15. The system of claim 1, further comprising at least a first gas sensor positioned adjacent to a vent of the external housing of the first cell pack and a second gas sensor positioned adjacent to a vent of the external housing of the second cell pack;

wherein the first gas sensor and the second gas sensor are each configured to sense at least one gas associated with a thermal event in the plurality of battery cells; and wherein detection of the submersion event includes detecting with at least one of the first gas sensor or the second gas sensor the at least one gas associated with the thermal event.

16. A method of controlling a power system for a marine vessel, the power system comprising a plurality of battery cell packs, including at least a first cell pack and a second cell pack, each marine battery cell pack comprising a plurality of battery cells encapsulated in an external housing configured to be separately mounted in the hull of the marine vessel, and a vessel load powered by the plurality of battery cell packs, the method comprising:

sensing a presence of water with a low water sensor at a lowest point of the marine vessel occupied by at least one of the plurality of battery cell packs and/or with at least one high water sensor positioned higher on the marine vessel than the low water sensor;

detecting an inversion of at least one of the plurality of battery cell packs;

in response to detecting the inversion, identify a logic for detecting a submersion event based on the output of the high water sensor and the output of the low water sensor;

detecting the submersion event based on the presence of water sensed by the high water sensor and/or the low water sensor; and generating an ingress mitigation action in response to detection of the submersion event.

17. The method of claim 16, further comprising starting a timer upon detecting water with the low water sensor; and detecting the submersion event upon the timer reaching a predetermined exposure time or upon sensing the presence of water with the high water sensor.

18. A power system for a marine vessel, the system comprising:

a plurality of battery cell packs, including at least a first cell pack and a second cell pack, each battery cell pack comprising a plurality of battery cells encapsulated in an external housing configured to be separately mounted in the hull of the marine vessel;

an orientation sensor associated with at least one of the plurality of battery cell packs;

a vessel load powered by the plurality of battery cell packs;

at least one low water sensor positioned at a lowest point of the marine vessel occupied by at least one of the plurality of battery cell packs;

at least one high water sensor positioned higher on the marine vessel than the low water sensor;

at least one hardware controller configured to:

detect an inversion of the at least one of the plurality of battery cell packs;

in response to detecting the inversion, identify a logic for detecting a submersion event based on the output of the high water sensor and the output of the low water sensor;

detect the submersion event based on an output of the high water sensor and an output of the low water sensor; and generate an ingress mitigation action in response to detection of the submersion event.

19. The system of claim 18, wherein, in response to detecting the inversion, the controller is configured to operate the at least one high water sensor to sense water at a low portion of the plurality of battery cell packs.

20. The system of claim 18, wherein the low water sensor is a float switch and wherein, in response to detecting the inversion, the at least one hardware controller is configured to interpret an off position of the float switch as sensing the presence of water.

* * * * *